US010024114B2

(12) United States Patent
Vandapel et al.

(10) Patent No.: US 10,024,114 B2
(45) Date of Patent: Jul. 17, 2018

(54) DUST SUPPRESSION METHOD AND SYSTEM FOR AN AUTONOMOUS DRILLING MACHINE

(71) Applicant: Caterpillar Inc., Peoria, IL (US)

(72) Inventors: Nicolas François-Xavier Christophe Vandapel, Pittsburgh, PA (US); Michael Karl Wilhelm Happold, Pittsburgh, PA (US); Meenal Patel, Pittsburgh, PA (US)

(73) Assignee: Caterpillar Inc., Deerfield, IL (US)

( * ) Notice: Subject to any disclaimer, the term of this patent is extended or adjusted under 35 U.S.C. 154(b) by 118 days.

(21) Appl. No.: 15/015,236

(22) Filed: Feb. 4, 2016

(65) Prior Publication Data

US 2017/0226808 A1 Aug. 10, 2017

(51) Int. Cl.
*E21B 12/06* (2006.01)
*E21B 21/015* (2006.01)

(52) U.S. Cl.
CPC ..... *E21B 12/06* (2013.01); *E21B 21/015* (2013.01)

(58) Field of Classification Search
CPC ..... E21B 12/06; E21B 44/10
See application file for complete search history.

(56) References Cited

U.S. PATENT DOCUMENTS

| | | | | |
|---|---|---|---|---|
| 6,954,719 | B2 | 10/2005 | Carter, Jr. et al. | |
| 7,001,444 | B2 | 2/2006 | Small | |
| 8,360,343 | B2 | 1/2013 | Gudat et al. | |
| 9,026,270 | B2 | 5/2015 | Poettker et al. | |
| 9,046,895 | B2 | 6/2015 | Orr et al. | |
| 2011/0160919 | A1* | 6/2011 | Orr | G05D 7/0676 700/283 |
| 2014/0343754 | A1* | 11/2014 | Poettker | G05D 1/0016 701/2 |
| 2017/0138192 | A1* | 5/2017 | Wang | E21C 37/00 |

FOREIGN PATENT DOCUMENTS

| | | |
|---|---|---|
| CN | 2097903 | 3/1992 |
| CN | 202991046 | 6/2013 |
| CN | 103422881 | 12/2013 |
| CN | 203702231 | 7/2014 |

* cited by examiner

*Primary Examiner* — Nicole Coy
*Assistant Examiner* — Yanick A Akaragwe
(74) *Attorney, Agent, or Firm* — James S. Bennin

(57) ABSTRACT

A method for dust suppression for an autonomous drilling machine operating at a work site. The method comprises of generating by a perception module perception data of the work site, receiving at least one machine parameter from a machine sensor of the autonomous drilling machine, predicting by a controller a dust level for the autonomous drilling machine at the work site based on one of the perception data or the machine parameter, determining a fluid discharge rate for a fluid discharge unit based on the predicted dust level, and adjusting the fluid discharge rate based on dust level detected during the drilling operation.

20 Claims, 5 Drawing Sheets

DUST SUPPRESSION METHOD AND SYSTEM FOR AN AUTONOMOUS DRILLING MACHINE

TECHNICAL FIELD

The present disclosure relates generally to the control of work site dust conditions. More particularly the present disclosure relates to a dust detection and suppression system for a drilling machine.

BACKGROUND

Work sites associated with certain industries, such as the mining and construction industries, are susceptible to undesirable dust conditions. For example, work sites associated with mining, excavation, construction, landfills, and material stockpiles may be particularly susceptible to dust due to the nature of the materials composing the work site ground surface.

Work sites employ various types of drilling machines to perform drilling operations. The drilling operation is known to generate large amounts of dust, especially on encountering hard and abrasive rocks. Various dust control systems and methods have been developed for suppressing dust and controlling the amount of dust released during drilling operation. One of the methods for suppressing dust is water spraying or injecting water into the blast holes for treating work site dust conditions. For example, Chinese Patent No. 202991046U discloses a mine automatic watering and dust removal device. Particularly, 046' discloses an electric valve can be controlled to be opened and closed automatically for achieving automatic spraying of water and removing dust under an unmanned situation. Further, Chinese Patent No. 103422881A discloses an intelligent mining atomization dust settling device wherein adjustable electromagnetic valves can be used for automatically adjusting water and gas supply according to different dust concentrations, to achieve low concentration of dust.

The dust detection systems disclosed in the 046' patent and the 881' patent may however not be efficient in suppressing dust. For example, the amount of water to be sprayed cannot be efficiently determined for varying ground or operation conditions. As a result, excess water may be sprayed causing wastage or insufficient water may be sprayed resulting in poor dust control.

SUMMARY OF THE INVENTION

In an aspect of the present disclosure, a method for dust suppression for an autonomous drilling machine operating at a work site is disclosed. The method comprises of generating by a perception module a perception data of the work site, receiving at least one machine parameter from a machine sensor of the autonomous drilling machine, predicting by a controller a dust level for the autonomous drilling machine at the work site based on one of the perception data or the machine parameter, determining a fluid discharge rate for a fluid discharge unit based on the predicted dust level, and adjusting the fluid discharge rate based on dust level detected during the drilling operation.

In another aspect of the present disclosure, a dust suppression system for an autonomous drilling machine operating at a work site is disclosed. The dust suppression system comprises of a perception module configured to generate a perception data of a work site, at least one machine sensor configured to communicate at least one machine parameter of the autonomous drilling machine, a fluid discharge unit for discharge of fluid to a work site for suppression of dust, and a controller. Further, the controller is configured to receive the perception data from the perception module, receive the machine parameter from the machine sensor, predict a dust level for the autonomous drilling machine at the work site based on one of the perception data or the machine parameter, determine a fluid discharge rate for the fluid discharge unit based on the predicted dust level, and adjust the fluid discharge rate based on dust level detected during the drilling operation.

In yet another aspect of the present disclosure, an autonomous drilling machine is disclosed. The autonomous drilling machine comprises of at least one machine sensor configured to communicate at least one machine parameter of the autonomous drilling machine, a fluid discharge unit for discharge of fluid to a work site for suppression of dust, and a controller. The controller is configured to receive a perception data from a perception module configured to generate the perception data of a work site, receive the machine parameter from the machine sensor, predict a dust level for the autonomous drilling machine at the work site based on one of the perception data or the machine parameter, determine a fluid discharge rate for the fluid discharge unit based on the predicted dust level, detect a dust level for the autonomous drilling machine at the work site during the drilling operation based on the perception data, and adjust the fluid discharge rate based on the dust level detected during the drilling operation.

DETAILED DESCRIPTION

Reference will now be made in detail to the embodiments of the invention, examples of which are illustrated in the accompanying drawings. Wherever possible, the same reference number will be used throughout the drawings to refer to the same or like parts.

Figure 1:
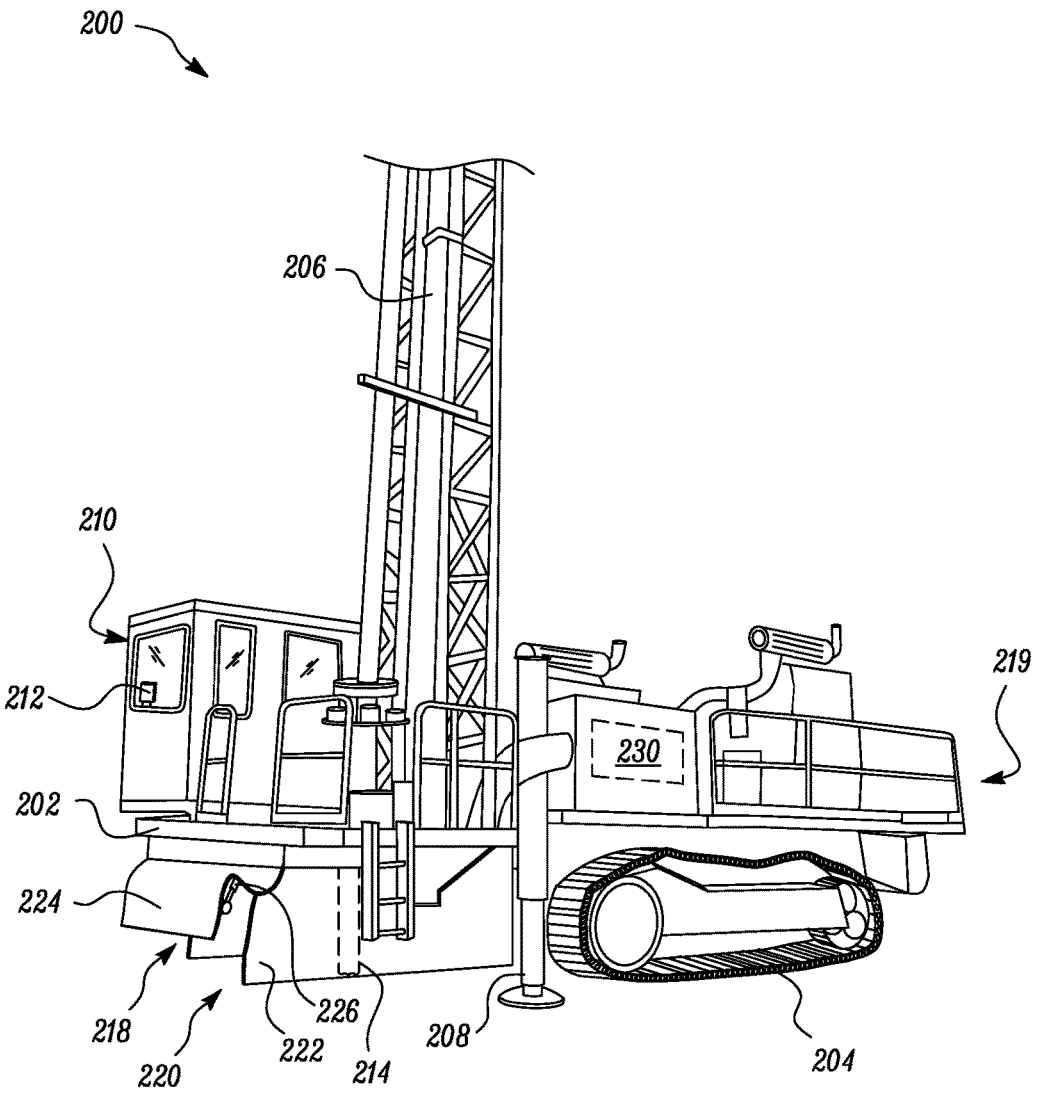
FIG. 1 illustrates an autonomous drilling machine on a work site.
Figure 3:
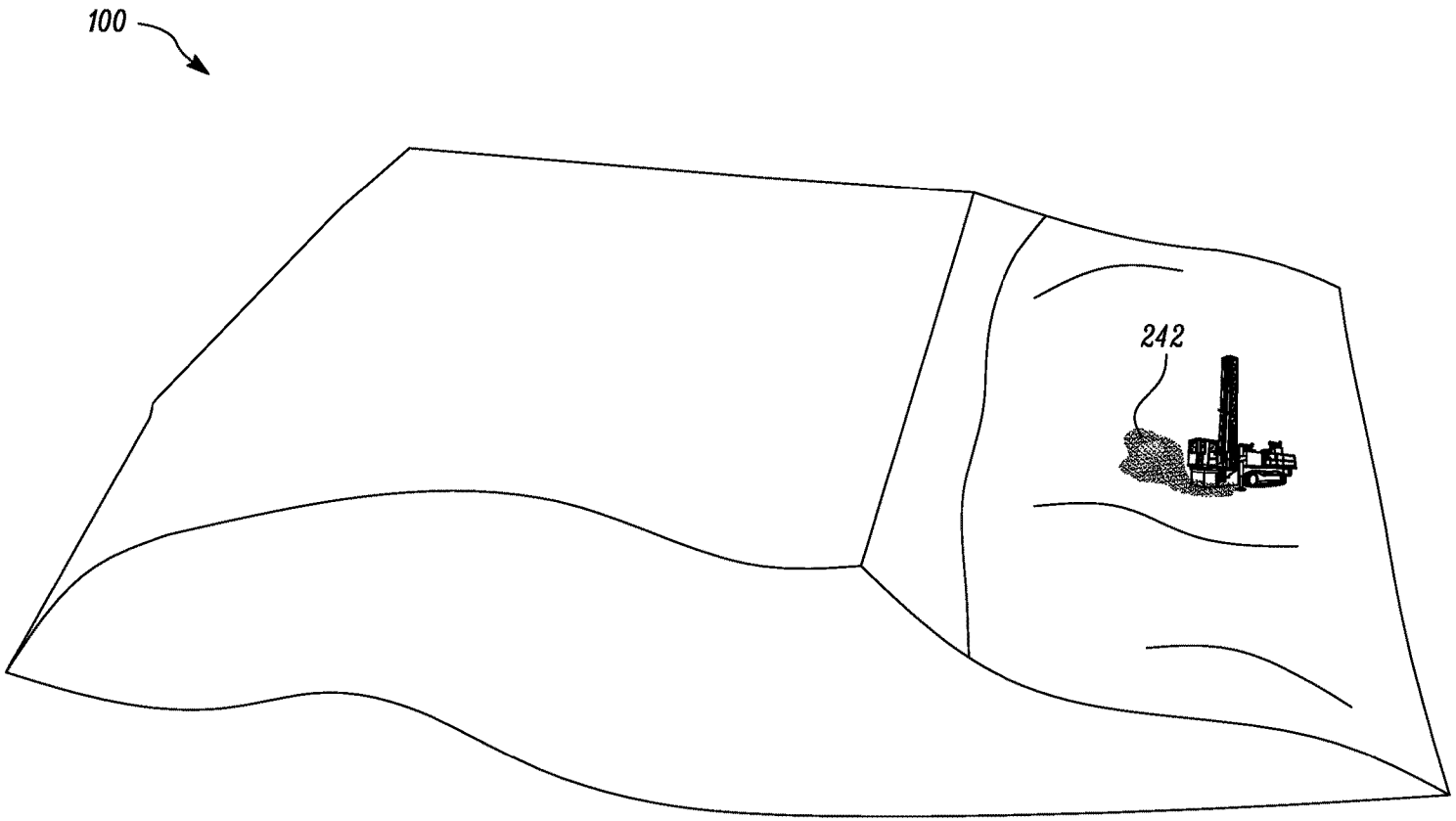
FIG. 3 illustrates a 3D scene representation of a work site.

FIG. 1 illustrates an autonomous drilling machine 200 in accordance with an embodiment of the present disclosure. The autonomous drilling machine 200 may be configured to operate on a work site 100 as shown in FIG. 3. The work site 100 may be a construction site or a mining site. Although an autonomous drilling machine 200 is contemplated, various other drilling machines known in the art with various level of autonomy, such as a manually operated drilling machine, semiautonomous drilling machine, remotely operated drilling machines, or remotely supervised drilling machines, would also apply. The autonomous drilling machine 200 may be a blast hole drill, a rotary drill, a surface drill etc. In an alternate embodiment, the machine 200 may be other types of earth-working machines for performing various operations at the work site 100. In various other embodiments, the machine 200 may be a transportation machines, transporting the excavated material to another location, which may generate dust at the work site 100.

The autonomous drilling machine 200 may include a frame 202 supported on a transport mechanism, such as, crawler tracks 204 in the rear portion 219 as illustrated in the FIG. 1. The autonomous drilling machine 200 may further include a mast 206 mounted on the frame 202 and supported about a pivot (not shown). The autonomous drilling machine 200 may include jacks 208 that may be extended to support the autonomous drilling machine 200 during drilling operation. The autonomous drilling machine 200 may further include a cabin 210. A display unit 212 may be located in the cabin 210 for displaying visual data of the current operations of the autonomous drilling machine 200 to an operator.

In accordance with a further embodiment, the autonomous drilling machine 200 may include a control panel (not shown). The control panel may be located in the cabin 210. The on-board controllers may be configured to receive control signals from an operator or from a remote location for controlling various components or operation of the autonomous drilling machine 200.

The autonomous drilling machine 200 further includes a work tool 214, supported by the mast 206, for performing the drilling operation. The work tool 214 may be a drill bit or a bore bit. In various other embodiments, the work tool 214 may be any other work tool used in the performance of a work-related task. For example, work implement may include one or more of a blade, a shovel, a ripper, a dump bed, a fork arrangement, a broom, a grasping device, a cutting tool, a digging tool, a propelling tool, a bucket, a loader or any other tool known in the art.

The autonomous drilling machine 200 may include a dust containment assembly 218 provided below the frame 202, of the autonomous drilling machine 200. The dust containment assembly 218 defines an enclosure 220 for covering the work tool 214 between one or more walls 222 and a dust curtain 224 In an embodiment, a plurality of dust curtains 224 may define the enclosure for covering the work tool 214. The drilling operation is performed by the work tool 214 within the enclosure 220 of the dust containment assembly 218.

Figure 4:
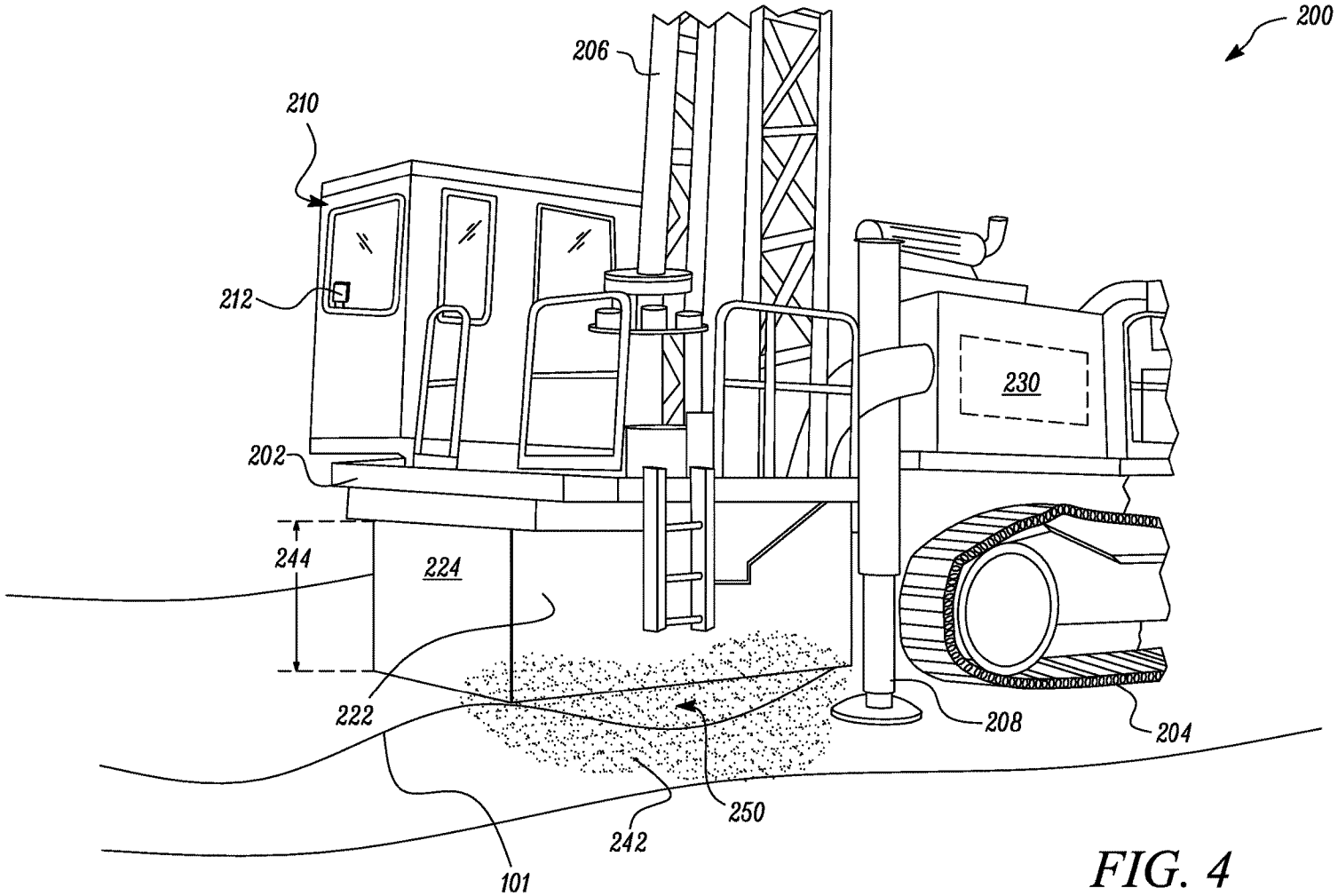
FIG. 4 illustrates a gap between the dust curtain of an autonomous drilling machine and the ground surface of a work site.

The dust containment assembly 218 may further include one or more actuators 226 attached to the frame 202 of the autonomous drilling machine 200. The one or more actuators 226 may be connected to the dust curtain 224. Based on the movement of the actuators 226, height 244 of the dust curtain 224 with respect to a ground surface 101 of the work site 100 can be adjusted, as shown in FIG. 4. In accordance with an embodiment, the actuators 226 may be hydraulically operated. It will be apparent to one of ordinary skill in the art that the actuators 226 may alternatively be operated pneumatically or mechanically, based on the system requirements.

Figure 2:
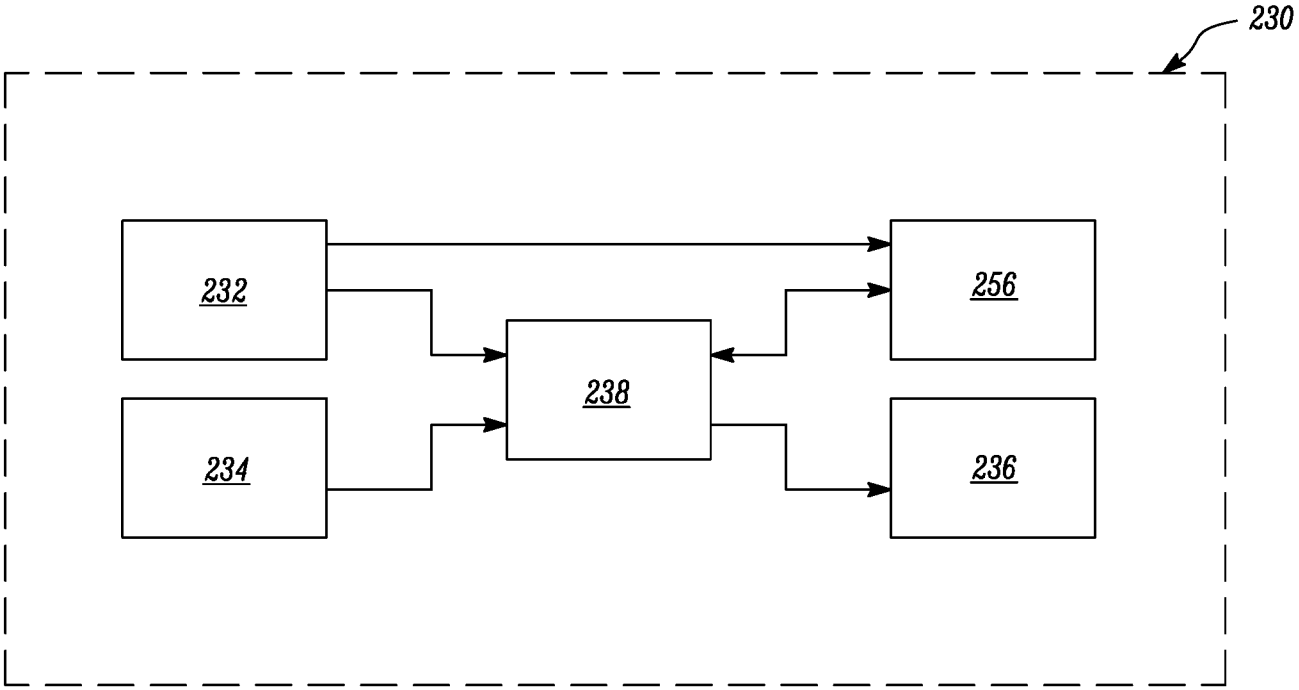
FIG. 2 illustrates a dust suppression system.

In the embodiment illustrated, the dust containment assembly 218 may be communicably coupled to a dust suppression system 230. Further, the dust suppression system 230 is operatively coupled to the autonomous drilling machine 200 as shown in FIG. 1. The dust suppression system 230 is configured to control amount of dust generated and released during movement or drilling operation performed by the autonomous drilling machine 200. Further, the dust suppression system 230 is configured to automatically detect and predict dust levels generated by the drilling operation of the autonomous drilling machine 200 at the work site 100. As shown in FIG. 2, the dust suppression system 230 includes a perception module 232, at least one machine sensor 234, a fluid discharge unit 236, and a controller 238.

In accordance with an embodiment, the autonomous drilling machine 200 may include one or more of these components of the dust suppression system 230. In accordance with another embodiment, one or more these components of the dust suppression system 230 may be located at a remote or a central location and may be configured to communicate the control signals for the autonomous drilling machine 200 through the control panel located in the autonomous drilling machine 200.

The perception module 232 may include at least one perception sensor (not shown). The perception module is configured to generate perception data of the work site 100. In accordance with an embodiment, the perception module 232 may include a light detection and ranging (LIDAR) device. In accordance with alternate embodiments, the perception module 232 may include perception sensors such as RADAR (radio detection and ranging) device, a stereo camera, a monocular camera, or another device known in the art. The perception module 232 may be disposed on the autonomous drilling machine 200. In other embodiments, at least one perception module 232 may be located on the autonomous drilling machine 200 and at least one perception module 232 may be remotely located, such as on a vertical structure (pole, tower) overseeing the site, an unmanned aerial vehicle or a satellite to generate the perception data.

The perception data obtained from the perception module 232 is used to determine the terrain and geometrical properties of the work site 100. The perception data along with position co-ordinates obtained from a position detection device to generate a terrain map for the work site including identifying the terrain features of the work site 100, such as a crest, a trough, a wall, spill pile, cuttings pile, high fidelity ground etc. The position detection device may be any one or a combination of a Global Positioning System (GPS), a Global Navigation Satellite System, a Pseudolite/Pseudo-Satellite, any other Satellite Navigation System, an Inertial Navigation System or any other known position detection system known in the art.

In accordance with an embodiment, the perception data generated by the perception module 232 includes a three dimensional (3D) point cloud representation of the work site 100. In another embodiment, the perception module 232 may generate 2D images of the work site 100 or at least the portion of the work site 100. The perception module 232 may analyze the 3D point cloud/2D images to determine the ground, non-ground regions of the terrain, and dust. The ground regions may be an indicator of the ground surface 101 of the work site 100. The non-ground region may be an indicator of and obstacle detected at the work site 100.

FIG. 3 shows an exemplary 3D representation of the work site 100 obtained by the perception module 232 wherein dust 242 is identified from the 3D point cloud. In accordance with an embodiment, the perception module 232 may be configured to display the perception data on a display. In accordance with another embodiment, the display may be located at a remote location or a central location. In accordance with another embodiment, the perception module 232 may be configured to display the perception data on the display unit 212, as shown in FIG. 4. In an embodiment, the display unit 212 may be located in the cabin 210 of the autonomous drilling machine 200. In an alternate embodiment, the display unit 212 may be located at a remote location.

The machine sensor 234 may be disposed on the autonomous drilling machine 200 and is configured to communicate at least one machine parameter of the autonomous drilling machine 200, as shown in FIG. 2 and FIG. 4. In alternate embodiments, a plurality of machine sensors 234 may be disposed on the autonomous drilling machine 200. The machine parameters may include acceleration, angular velocity, pitch or rotation, or any other mechanical or inertial phenomena indicative of the drilling state of the autonomous drilling machine 200. In accordance with an embodiment, the machine parameter may include inertial measurements that may be identified by an inertial measurement unit (IMU) located on the autonomous drilling machine 200. The IMU may be configured to detect machine vibrations of the autonomous drilling machine 200 during the drilling operation.

The fluid discharge unit 236 may be disposed on the autonomous drilling machine 200, at a location in the enclosure 220 of the dust containment assembly 218. In an alternate embodiment, the fluid discharge unit 236 may be located at one or more locations of the work site 100. In accordance with another embodiment, the fluid discharge unit 236 may be disposed on one or more mobile fluid delivery machines for the purpose of spraying fluid at the work site 100.

The fluid discharge unit 236 may include a fluid storage tank (not shown) for storing fluid, one or more spray heads (not shown) that are configured to spray the fluid stored in the fluid storage tank, and various other component such a piping, hoses, pumps, and valves. In an embodiment, some of the spray heads may be mounted on the frame 202 surrounding the dust containment assembly 218.

The controller 238 is communicably coupled to the fluid discharge unit 236. The controller 238 is also communicably coupled to the perception module 232 and the one or more machine sensors 234. In accordance with an embodiment, the controller 238 may be communicably coupled to the control panel located on the autonomous drilling machine 200. In accordance with an embodiment, the controller 238 may be integrated with the control panel of the autonomous drilling machine 200.

The controller 238 is configured to receive the perception data from the perception module 232 and one or more machine parameters from the machine sensors 234, to predict dust levels at the work site 100. Based on the location co-ordinates of the autonomous drilling machine 200, the controller 238 may identify the terrain where the drilling operation is taking place. The controller 238 may further obtain the height 244 of the dust curtain 224 and the walls 222 of the enclosure from the machine sensors 234 and compare the height 244 of the dust curtain 224 with the ground surface 101 of the work site 100 on which drilling operation takes place. In other embodiments, standard height for various dust curtains 224 and the walls 222 of the enclosure may be available with the controller 238. Based on the comparison, a gap 250 is determined by the controller 238 between the dust curtain 224 and the ground surface 101 of the work site 100. Further the dust likely to be generated due to the gap 250 is predicted by the controller 238. If the gap 250 is large, more dust is likely to escape, and if the gap 250 is small, less dust is likely to escape. Accordingly, the dust level may be predicted in a proportional amount corresponding to the gap 250. FIG. 4 illustrates dust 242 released outside the enclosure due to the gap 250 between the dust curtain 224 and the ground surface 101 of the work site 100.

The controller 238 may also be configured to receive one or more machine parameters from the machine sensors 234 to predict dust levels at the work site 100. For example, the controller 238 may be configured to receive inertial measurements of the drill, vibration levels of the drill or power and torque requirements. Further, the controller 238 may be configured to predict dust generation by correlating these machine parameters to an encounter of hard rock, a hard ground or a high fidelity terrain of the work site 100. For example, large amount of dust generation can be predicted by the controller 238 on detection of an increase in machine vibration. Whereas, low level of vibration, power, and torque can be correlated to a soft ground and therefore low levels of dust can be predicted.

Further, based on the predicted dust levels, the controller 238 is configured to determine a fluid discharge rate for the fluid discharge unit 236. The controller 238 may also be configured to actuate the fluid discharge unit 236. Further, the controller 238 is also configured to automatically adjust the fluid discharge rate based on actual dust levels detected to bring the dust levels within control. The controller 238 may be configured to compare the dust level predicted and the actual dust levels detected to adjust the fluid discharge rate of the fluid discharge unit 236. The dust 242 may be detected at the work site 100 from the perception data generated by the perception module 232, as disclosed above and shown in FIG. 3. Based on the dust 242, the dust level on at least a portion of the work site 100 may be determined. In accordance with another embodiment, the dust level may be detected by various other known forms of dust detection sensors that may be disposed on the autonomous drilling machine 200 or may be located at different locations on the work site 100. In various other embodiment, the dust detection may be carried out remotely by various satellite imaging techniques known in the art.

In accordance with another embodiment, the controller 238 may also be configured to adjust the height 244 of the dust curtain 224. In accordance with another embodiment, the fluid discharge unit 236 may be used in conjunction with the adjustable dust curtain 224 by the dust suppression system 230 to control the dust generation by the autonomous drilling machine 200 at the work site 100.

The controller 238 may embody a single microprocessor or multiple microprocessors that include means for receiving signals from the perception module 232, the machine sensors 234, and the fluid discharge unit 236. Numerous commercially available microprocessors may be configured to perform the functions of the controller 238. It should be appreciated that the controller 238 may readily embody a general machine microprocessor capable of controlling numerous machine functions. A person of ordinary skill in the art will appreciate that the controller 238 may additionally include other components and may also perform other functionalities not described herein.

In accordance with an embodiment, the dust suppression system 230 may include a learning module 256 in communication with the controller 238 and the perception module 232, as shown in FIG. 2. The learning module 256 may include predetermined models for dust level predictions corresponding to various ground conditions, such as a soft ground or a rough ground, and operating conditions of the autonomous drilling machine 200, such as vibration and torque levels. In accordance with an embodiment, the perception module 232 may also transmit the detected dust levels to the learning module 256. The detected dust levels may be transmitted periodically to the learning module 256. The learning module 256 may compare periodically or at any point of time the predicted dust levels and the detected dust levels. In case the predicted dust levels do not match or do not fall in the range of the detected dust levels, the learning module 256 may modify or update the predetermined models of dust level predictions. The modification may be based on the amount of the corresponding dust level detected as compared to the predicted dust level. In an embodiment, the modification may be in a proportional amount of the corresponding dust level detected as compared to the predicted dust level. In an alternate embodiment, the learning module 256 may receive the perception data from the controller 238 and the dust level detected by the controller 238. The learning module 256 may then run various algorithms on the perception data and the detected dust level to determine the modification to be made to the predetermined predicted dust level. Thereby, the learning module 256 adaptively improves the dust prediction capabilities of the dust suppression system 230.

INDUSTRIAL APPLICABILITY

Work sites associated with mining, excavation, construction, landfills, and material stockpiles may be particularly susceptible to dust due to the nature of the materials composing the work site ground surface. This may reduce productivity of the machine operation. Further, the machines working in dusty conditions may have low visibility thereby being susceptible to accidents.

In an aspect of the present disclosure, a dust suppression system 230 is provided for the autonomous drilling machine 200. The dust suppression system 230 detects and controls the dust generated by the autonomous drilling machine during operation. Further, the dust suppression system 230 predicts the amount of dust generated and controls the fluid discharge rate to efficiently minimize dust present in the work site 100. The dust suppression system 230 includes a perception module 232, at least one machine sensor 234, a fluid discharge unit 236, and a controller 238.

Figure 5:
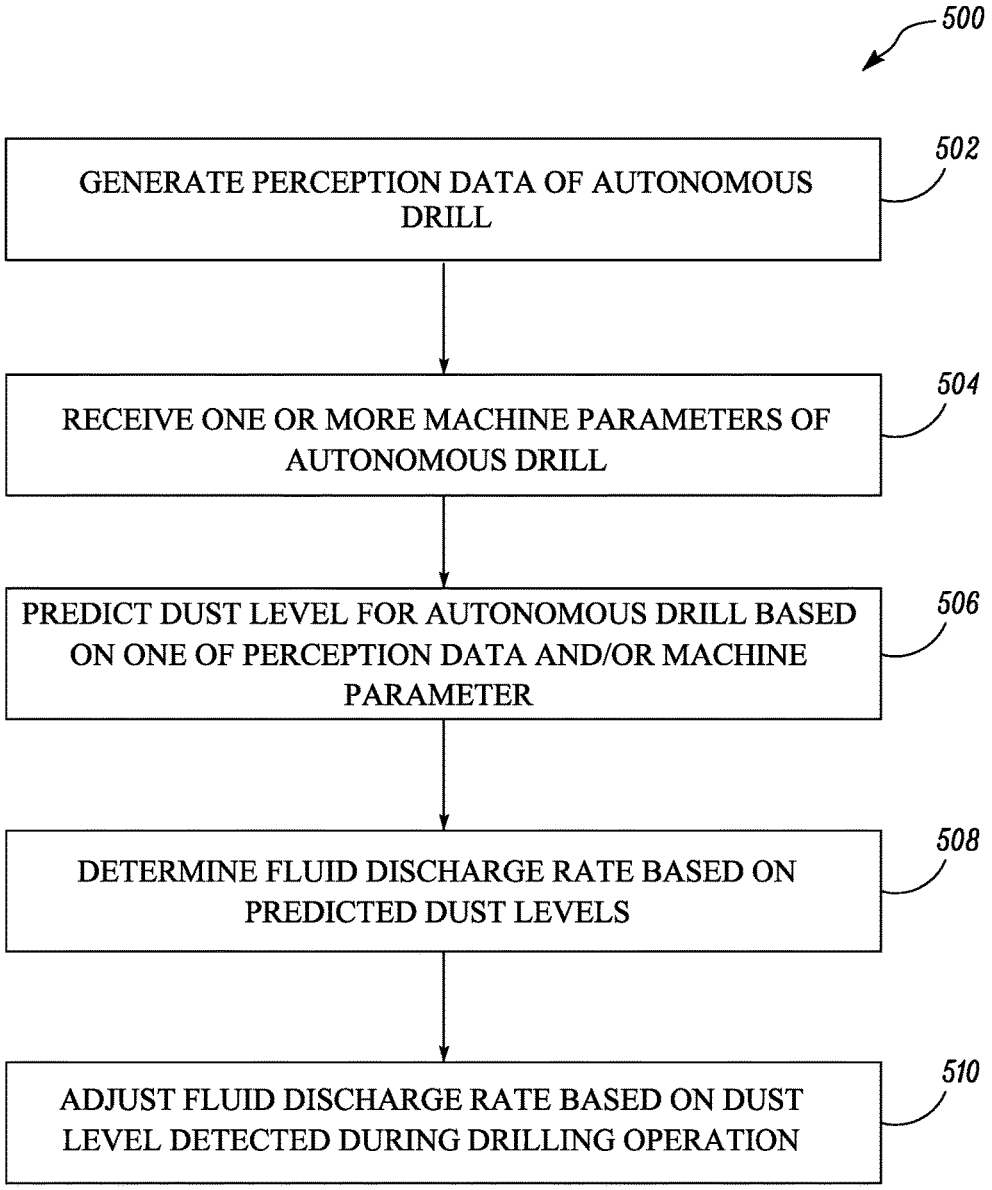
FIG. 5 illustrates a method for dust suppression for an autonomous drilling machine

Further, the present disclosure provides a method 500 of dust suppression for an autonomous drilling machine 200. The method 500 of dust suppression for an autonomous drilling machine 200 will now be explained with reference to FIG. 5. The perception module 232 generates perception data i.e. a 3D map of the work site 100 (Step 502). The 3D map may be generated using light detection and ranging sensor (LIDAR) data. The 3D map determines profile of the ground surface 101. The machine sensors 234 communicates at least one machine parameter to the controller 238 (Step 504). The machine parameters may be acceleration, angular velocity, pitch or rotation, or any other mechanical or inertial phenomena indicative of the drilling state of the autonomous drilling machine 200.

The controller 238 receives the perception data from the perception module 232 and receives the machine parameter from the machine sensor 234. Based on the data received by the controller 238 predicts the dust level for the autonomous drilling machine 200 at the work site 100 (Step 506). Based on the dust level predicted by the controller 238 a fluid discharge rate is determined (Step 508). The fluid discharge rate is then transmitted to the fluid discharge unit 236. Accordingly, the fluid discharge unit 236 sprays fluid at the work site 100 to suppress the dust generated at the work site 100. After the fluid discharge rate is determined, the perception module 232 detects the dust level generated by the autonomous drilling machine 200 during operation. The detected dust level is then transmitted to the controller 238. Based on the detected dust level the controller 238 adjusts the fluid discharge rate (Step 510).

In accordance with an aspect of the present disclosure, the predicting the dust level (step 506) includes comparing the ground surface 101 of the work site 100 and the height 244 of the dust curtain 224, to estimate a gap 250 between the ground surface 101 and the dust curtain 224. In accordance with another aspect of the present disclosure, predicting the dust level (step 506) is also based on the machine vibrations, power and torque obtained from the machine sensors 234. This ensures that optimum amount of fluid is sprayed to suppress the dust generated at the work site 100.

In case the controller 238 predicts a low level of dust and the autonomous drilling machine 200 generates a high level of dust, the fluid discharge rate may be accordingly automatically adjusted to suppress the dust level at the work site 100. This ensures adequate amount of fluid being sprayed by the fluid discharge unit 236 during operation. Further, in case the controller 238 predicts a high level of dust and the autonomous drilling machine 200 generates a low level of dust, the fluid discharge rate may be automatically reduced to suppress the dust level at the work site 100. This prevents loss of fluid due to incorrect predictions by the controller 238. The automatic adjustment of the fluid discharge rate obviates operator input to suppress the dust levels at the work site 100. Further, automatic suppression of the dust levels by the dust suppression system also helps maintain safety, health and environmental standards during the drilling operation.

While aspects of the present disclosure have seen particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

The invention claimed is:

1. A method of dust suppression for an autonomous drilling machine operating on a work site, the method comprising:

generating, by a perception module, perception data of a work site;

receiving at least one machine parameter from a machine sensor of the autonomous drilling machine;

predicting, by a controller, a dust level for the autonomous drilling machine at the work site based on at least one of the perception data or the machine parameter;

determining a fluid discharge rate for a fluid discharge unit based on the predicted dust level;

detecting a dust level during a drilling operation of the autonomous drilling machine;

comparing the detected dust level and the predicted dust level;

adjusting the fluid discharge rate based on comparing the detected dust level and the predicted dust level, the fluid discharge rate being adjusted when the detected dust level is different than the predicted dust level, the fluid discharge unit spraying fluid, at the adjusted fluid discharge rate, to suppress dust generated at the work site during the drilling operation.

2. The method of claim 1 wherein generating the perception data includes determining a ground surface of the work site.

3. The method of claim 2 wherein the drilling operation is performed with an enclosure defined by a dust curtain, wherein a height of the dust curtain is changed to create a gap between the dust curtain and the ground surface, and wherein predicting the dust level includes estimating the gap between the dust curtain and the ground surface.

4. The method of claim 1 wherein generating the perception data includes determining a three dimensional (3D) point cloud representation of the work site.

5. The method of claim 4 wherein the dust level is detected using the three dimensional (3D) point cloud representation.

6. The method of claim 1 further comprising actuating the fluid discharge unit based on the determined or the adjusted fluid discharge rate.

7. The method of claim 1 further comprising modifying the dust level prediction based on dust level detected during the drilling operation.

8. A dust suppression system for an autonomous drilling machine operating at a work site the dust suppression system comprising:

a perception module configured to generate a perception data of the work site;

at least one machine sensor configured to communicate at least one machine parameter of the autonomous drilling machine;

a fluid discharge unit for discharge of fluid to a work site for suppression of dust; and a controller configured to:

receive the perception data from the perception module;

receive the machine parameter from the machine sensor;

predict a dust level for the autonomous drilling machine at the work site based on at least one of the perception data or the machine parameter;

determine a fluid discharge rate for the fluid discharge unit based on the predicted dust level;

detect a dust level during a drilling operation of the autonomous drilling machine;

determine that the detected dust level is different than the predicted dust level; and adjust the fluid discharge rate based on determining that the detected dust level is different than the predicted dust level.

9. The dust suppression system of claim 8 wherein the controller is configured to determine a ground surface of the work site from the perception data.

10. The dust suppression system of claim 9 wherein the drilling operation is performed with an enclosure defined by a dust curtain, wherein a height of the dust curtain is changed to create a gap between the dust curtain and the ground surface, and wherein the controller is configured to estimate a gap between a dust curtain of the autonomous drilling machine and the ground surface to predict the dust level.

11. The dust suppression system of claim 8 wherein the perception data is a 3D point cloud of the work site.

12. The dust suppression system of claim 11 wherein the controller is configured to detect the dust level using the 3D point cloud.

13. The dust suppression system of claim 8 wherein the perception module includes a light detection and ranging sensor.

14. The dust suppression system of claim 8 wherein the machine parameter is at least one inertial measurement of the autonomous drilling machine.

15. The dust suppression system of claim 8 wherein the controller is further configured to actuate the fluid discharge unit based on the determined or the adjusted fluid discharge rate.

16. The dust suppression system of claim 8 further comprising a learning module configured to modify the dust level prediction if dust is detected.

17. An autonomous drilling machine comprising:

a perception module configured to generate a perception data of a work site;

at least one machine sensor configured to communicate at least one machine parameter of the autonomous drilling machine;

a fluid discharge unit for discharge of fluid to a work site for suppression of dust; and a controller configured to:

receive the perception data from the perception module;

receive the machine parameter from the machine sensor;

predict a dust level for the autonomous drilling machine at the work site based on at least one of the perception data or the machine parameter;

determine a fluid discharge rate for the fluid discharge unit based on the predicted dust level;

detect a dust level for the autonomous drilling machine at the work site during the drilling operation based on the perception data;

compare the detected dust level and the predicted dust level; and adjust the fluid discharge rate based on comparing the detected dust level detected and the predicted dust level, the fluid discharge rate being adjusted when the detected dust level is different than the predicted dust level.

18. The autonomous drilling machine of claim 17 further comprising a drill curtain defining at least a part of an enclosure below the frame of the machine.

19. The autonomous drilling machine of claim 17 wherein the controller is further configured to modify the predicted dust level based on dust level detected during the drilling operation.

20. The autonomous drilling machine of claim 17 wherein the machine sensor is an inertial measurement unit.

* * * * *